US005590439A

United States Patent [19]

Alazet

[11] Patent Number: 5,590,439

[45] Date of Patent: Jan. 7, 1997

[54] APPARATUS FOR CLEANING BY SPREADING CLEANING LIQUID AND BY SUCTION OF THE USED LIQUID

[75] Inventor: Jean Alazet, Paris, France

[73] Assignee: Famulus, Paris, France

[21] Appl. No.: 365,234

[22] Filed: Dec. 28, 1994

[30] Foreign Application Priority Data

Jan. 14, 1994 [FR] France ..... 94 00349

[51] Int. Cl.[6] ..... A47L 5/24

[52] U.S. Cl. ..... 15/320; 15/344; 15/353; 15/401

[58] Field of Search ..... 15/320, 344, 401, 15/353

[56] References Cited

U.S. PATENT DOCUMENTS

| | | | |
|---|---|---|---|
| 3,184,780 | 5/1965 | Hageman . | |
| 4,899,418 | 2/1990 | Steiner et al. | 15/401 X |
| 5,099,545 | 3/1992 | Krasznai et al. | 15/401 X |

FOREIGN PATENT DOCUMENTS

| | | |
|---|---|---|
| 0215165 | 3/1987 | European Pat. Off. . |
| 2424218 | 11/1975 | Germany . |
| 2233217 | 1/1991 | United Kingdom . |
| WO93/18698 | 9/1993 | WIPO . |

*Primary Examiner*—Chris K. Moore
*Attorney, Agent, or Firm*—Young & Thompson

[57] ABSTRACT

A hand-held apparatus for cleaning by spraying cleaning liquid and by suction of the used liquid has a spray pump (20) for cleaning liquid associated with a brush (23) for spreading of the liquid on the surface to be cleaned. A flexible rubber wiper (14) has a suction opening for the used liquid. A used liquid reservoir (1) communicates with the suction orifice of the wiper (14) by a channel (13). A partitioning device (5) maintains under vacuum the used liquid reservoir (1). A control trigger (21) is provided for the spraying of the cleaning liquid and for the sucking up of the used liquid. A handle (3) functions as a grip and a manipulator.

6 Claims, 2 Drawing Sheets

APPARATUS FOR CLEANING BY SPREADING CLEANING LIQUID AND BY SUCTION OF THE USED LIQUID

BACKGROUND OF THE INVENTION

1. Field of the Invention

The invention relates to an apparatus for cleaning by spreading cleaning liquid and by suction of the used liquid.

2 Description of the Related Art

The document European Patent No. 422,977 of the same inventor describes a suction apparatus with a flexible rubber wiper for the elimination of dirty water during cleaning of certain surfaces. The wiper comprises, according to a particular modified embodiment, a stepped cutout along one of the edges of its working end and also comprises at least one suction channel provided within the portion of the body of this wiper which is situated in vertical alignment with this stepped cutout.

The known apparatus comprises according to a particular modified embodiment a reservoir of cleaning liquid supplying by a series of small channels a spreading member such as a brush, and a reservoir for dirty cleaning liquid adapted to collect the dirty cleaning liquid after suction by a roller pump.

The assembly of the mentioned elements is mounted within a casing comprising a sleeve adapted to receive a manipulating sleeve or gripping handle.

This known device is generally satisfactory for intensive use, but is poorly adapted for household use for the following reasons: the casing integrating a roller pump and its drive motor, the two reservoirs and the necessary connecting conduits are of heavy weight, which renders the holding or displacement on the surfaces having contours such as staircases, relatively difficult; moreover, because most of the weight of the apparatus is in frictional contact on the substratum, the force to move it to be applied to the sleeve is high.

SUMMARY AND OBJECTS OF THE INVENTION

An object of the invention is to ensure complete cleaning by means of a lightweight device, adapted to be used frequently and without tiring the housekeepers.

Another object of the invention is to balance the distribution of the masses of the apparatus so as to facilitate its grasping, holding and use.

Another object of the invention is to provide an apparatus adapted particularly for cleaning glazed or vertical surfaces.

The invention has for its object a hand-held device for cleaning vertical glazed surfaces or other smooth surfaces by spraying cleaning liquid and by suction of the used liquid, comprising in combination: spraying and spreading means for cleaning liquid from a cleaning liquid reservoir, and suction and receiving means for the used liquid, characterized in that the suction and reception means for the used liquid comprise a reservoir for used liquid in which is provided a compartment containing means for applying vacuum to said used liquid reservoir, so as to place the center of gravity of the device in the lower portion and close to the gripping handle.

According to the invention, this apparatus is characterized in that:

said compartment is provided with a suction tube for air, emptying within the interior of said reservoir, and in that a suction channel for used liquid opens within the used liquid reservoir adjacent the base of the air aspiration tube, the spray means and the distribution means of the cleaning liquid are removable, for their replacement, the spraying means and the distribution means are disposed adjacent each other, the wiper and the distribution means are secured to a removable mounting fixed by clipping or screwing on the upper portion of the apparatus, the channel is of one piece with the used liquid reservoir and is elongated within this latter by a conduit, the cleaning liquid reservoir extends within a portion forming a handle.

BRIEF DESCRIPTION OF THE DRAWINGS

The invention will be better understood from the following description of an embodiment, with reference to the accompanying drawings, in which.

DETAILED DESCRIPTION OF THE PREFERRED EMBODIMENTS

Figure 1:
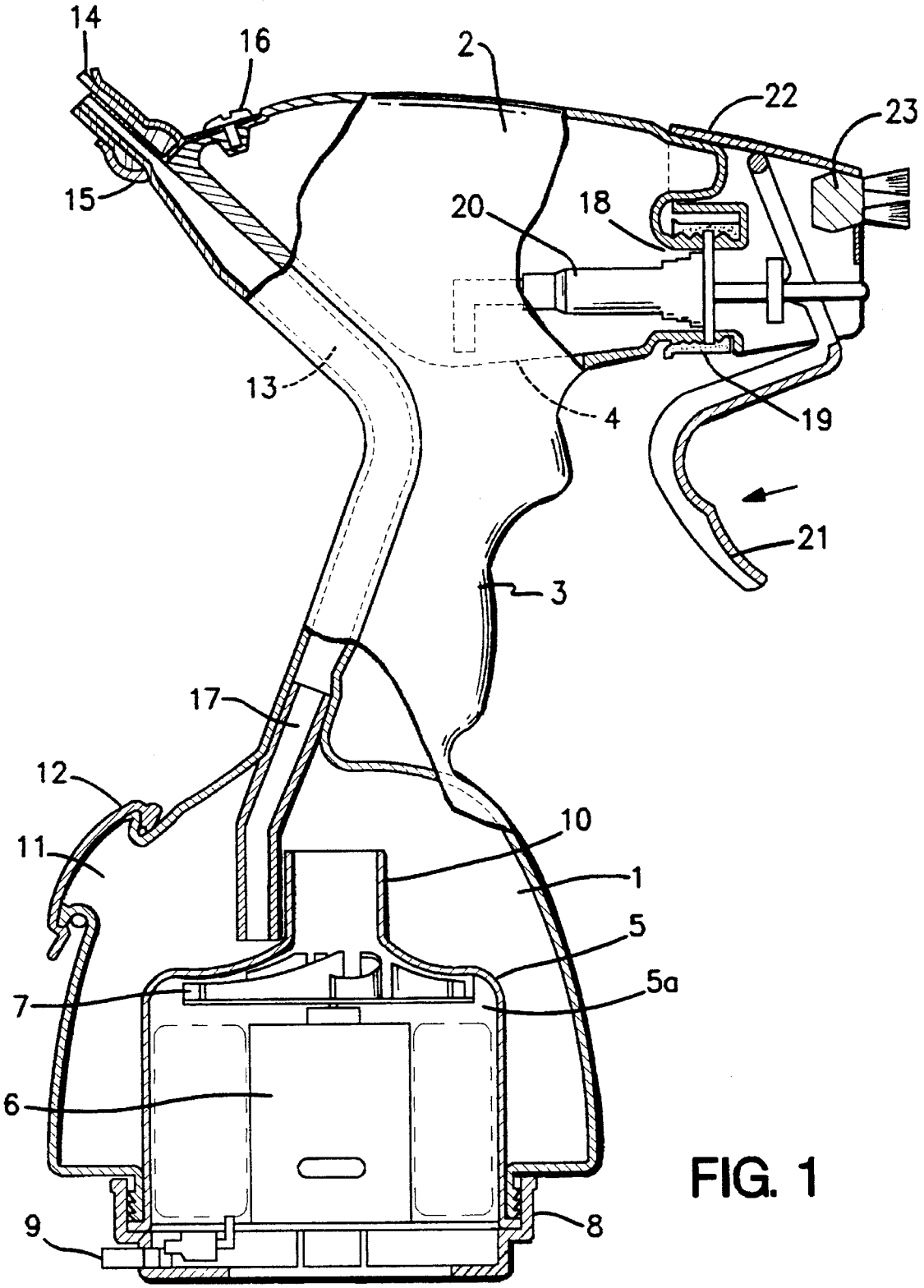
FIG. 1 is a schematic vertical medial cross-sectional view of an apparatus according to the invention.
Figure 2:
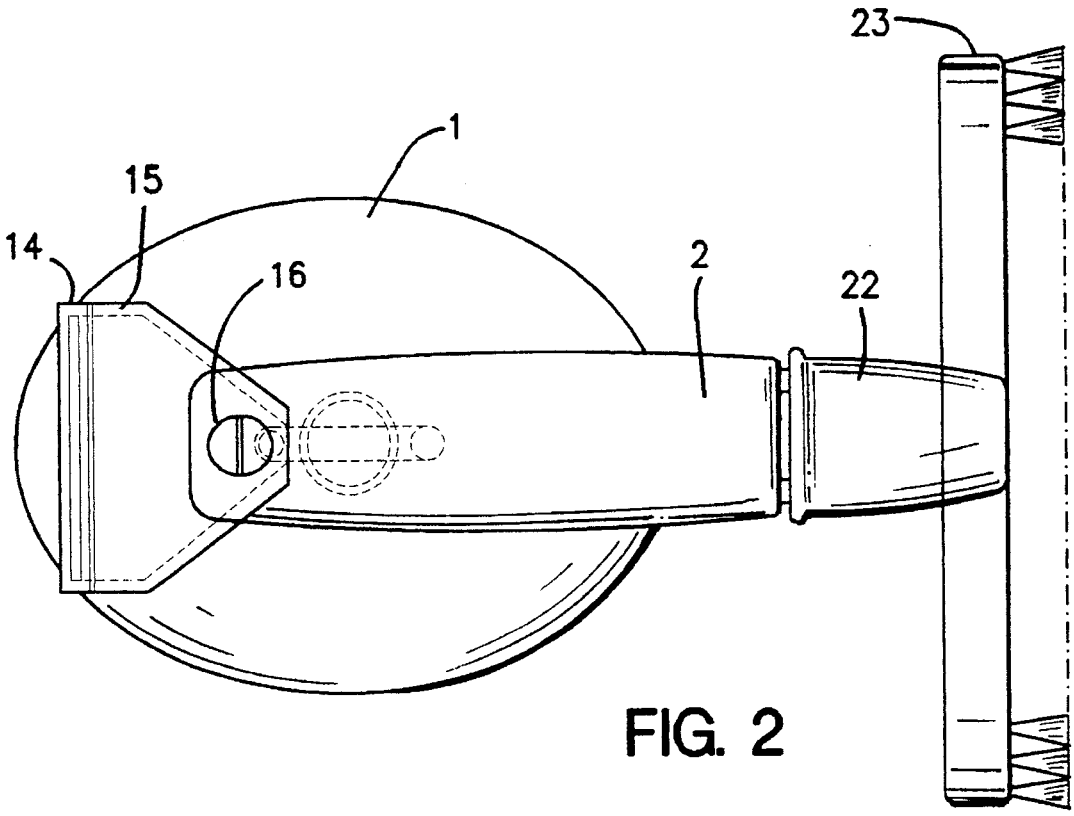
FIG. 2 is a schematic view from above of the apparatus of FIG. 1.
Figure 3:
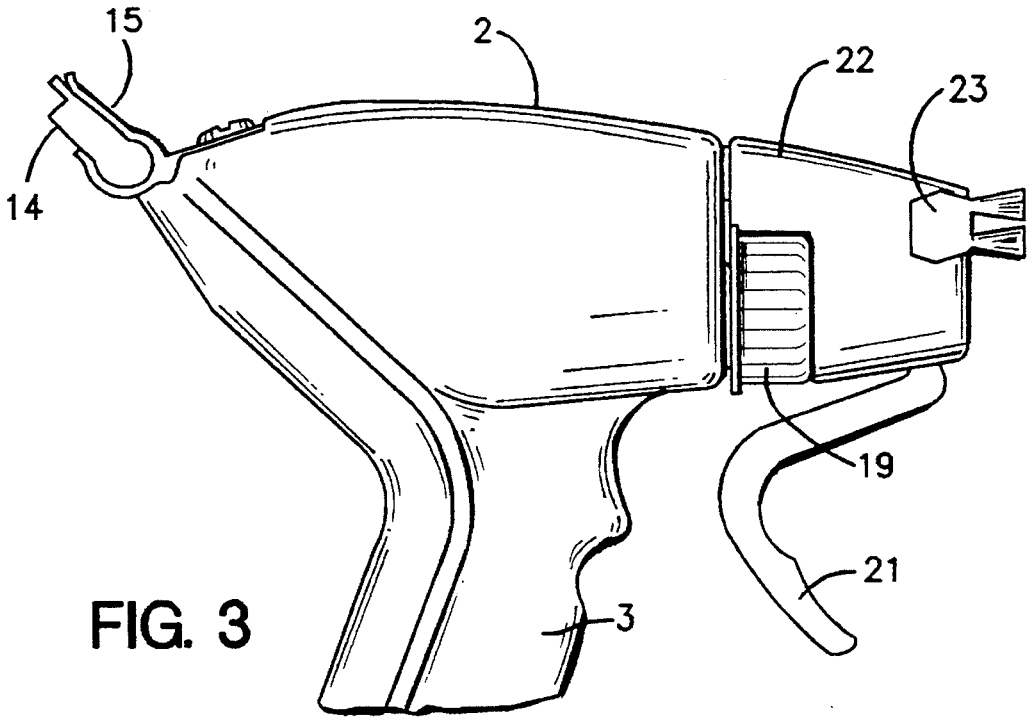
FIG. 3 is a schematic side view of the upper portion of the apparatus of FIG. 1.

The apparatus shown in the figures comprises, in a monobloc assembly, a lower reservoir 1 for used liquid, an upper reservoir 2 for cleaning liquid and a connecting portion 3 forming a gripping handle.

In the illustrated embodiment, the connecting portion 3 is separated from the upper reservoir 2 by a partition 4, but as a modification this partition could be omitted, thereby increasing the capacity of the cleaning liquid reservoir.

The used liquid reservoir 1 comprises an internal partition 5 forming a compartment **5*a* for vacuum means in the form of a small electric motor 6 associated with a fan rotor 7. The motor 6 is supplied by batteries (not shown) which could also be disposed in the compartment 5*a***.

In the illustrated embodiment, the compartment **5*a* is removably mounted relative to the reservoir 1 in which it is held in position by a lower cover 8 provided with a lateral passageway for the switch 9**.

The compartment **5*a* is provided at its upper portion with an air suction tube 10 in which a vacuum can be created within the reservoir 1 when the fan rotor 7 is driven by the motor 6**.

The reservoir 1 comprises a dumping opening 11 closed by a snap-on plug 12.

At its upper end, the used liquid reservoir 1 has the form of a channel 13 which extends to the upper end of the reservoir 2 for cleaning liquid, matching the shape of the handle 3 and the reservoir 2. The upper end of the channel 13 projects relative to this reservoir 2 and is surrounded by a flexible rubber wiper 14 mounted in a removable mounting 15 fixed to the reservoir 2 by a screw 16.

To avoid the liquid sucked through the channel 13 being introduced into the tubing 10, an additional channel 17 extends the channel 13 to the level of the base of the tubing 10.

Opposite the wiper 14, the reservoir 2 comprises a filling opening 18 closed by a screw plug 19. This screw plug 19 carries in a manner known per se, a spray pump 20 actuated by a trigger 21.

The plug 19 also carries a mounting 22 for support of a spreading means 23 for the cleaning liquid, here shown in the form of a brush, but which could as a modification be a sponge tongue or a porous tongue. The brush 23 will preferably be removable so as to permit its easy replacement in case of wear.

Preferably, the spray pump 20 and the brush 23 for the cleaning liquid are removable, for their replacement. The orifice of the spray pump 20 is preferably disposed adjacent the brush 23.

In the illustrated example, the wiper 14 is mounted directly on the reservoir 2 while the brush 23 is mounted fixedly on the plug 19 of reservoir 2.

According to a modified embodiment (not shown), the wiper 14 and the brush 23 could be integral with a common mounting extending to the upper portion of the reservoir 2 and fixed by screwing, clipping or any other means to said reservoir 2 constituting the upper portion of the apparatus.

I claim:

1. A hand-held apparatus for cleaning smooth surfaces, comprising: a reservoir (2) of cleaning liquid; pump means (20 for spraying the cleaning liquid from the reservoir (2) onto smooth surfaces being cleaned; means (14) for wiping used liquid from the smooth surfaces being cleaned; channel means (13) for receiving used liquid wiped from the smooth surfaces being cleaned; a reservoir (1) for said used liquid; additional channel means (17) for extending the channel means (13) into an interior of said reservoir (1) of used liquid; means for creating a vacuum in the reservoir (1) of used liquid; wherein said means for creating a vacuum are mounted inside a compartment (5*a*) formed by an internal part (5) of the used liquid reservoir; means (6, 7) in said compartment for creating a vacuum within said used liquid reservoir (1); air suction tubing (10) extending upwardly from said compartment for transmitting air from the used liquid reservoir (1) into said compartment for discharge outside said apparatus; said additional channel means (17) prolonging said channel means (13) down to the level of the base of said air suction tubing (10).

2. A hand-held apparatus, according to claim 1, wherein said means for creating a vacuum comprises electric motor means (6) and fan rotor means (7).

3. A hand-held apparatus, according to claim 1, further comprising removable means (22) for mounting the brush means (23) to the reservoir (2) of cleaning liquid.

4. A hand-held apparatus, according to claim 1, wherein said pump means (20) and said brush means (23) are disposed adjacent to each other.

5. A hand-held apparatus, according to claim 1, further comprising removable means (15) for mounting the wiping means (14) to an upper portion of the channel means (13).

6. A hand-held apparatus, according to claim 1, further comprising trigger means (21) for controlling flow of the cleaning liquid from the reservoir (2) through the pump means (20) to the brush means (23).

* * * * *